US005692325A

United States Patent [19]

Kuzutani

[11] Patent Number: 5,692,325

[45] Date of Patent: Dec. 2, 1997

[54] ATTACHMENT DETACHING APPARATUS FOR HYDRAULIC SHOVEL

[75] Inventor: Kazuteru Kuzutani, Kobe, Japan

[73] Assignee: Konan Electric Company Limited, Hyogo, Japan

[21] Appl. No.: 630,975

[22] Filed: Apr. 12, 1996

[30] Foreign Application Priority Data

Feb. 6, 1996 [JP] Japan ..... 8-019778

[51] Int. Cl.[6] ..... E02F 3/96

[52] U.S. Cl. ..... 37/468; 37/406; 414/723

[58] Field of Search ..... 37/463, 403–410; 414/723, 724; 403/322, 325

[56] References Cited

U.S. PATENT DOCUMENTS

| | | | |
|---|---|---|---|
| 4,355,945 | 10/1982 | Pilch | 414/723 X |
| 4,810,162 | 3/1989 | Foster | 414/723 |
| 4,881,867 | 11/1989 | Essex et al. | 414/723 |
| 5,082,389 | 1/1992 | Balemi | 37/468 X |
| 5,382,110 | 1/1995 | Perotto et al. | 414/723 X |
| 5,423,625 | 6/1995 | Gebauer et al. | 37/468 X |
| 5,456,030 | 10/1995 | Barone et al. | 37/468 |
| 5,549,440 | 8/1996 | Cholakon et al. | 37/468 X |
| 5,581,917 | 12/1996 | Barden | 414/723 X |

FOREIGN PATENT DOCUMENTS 715849 3/1995 Japan .

*Primary Examiner*—Terry Lee Melius
*Assistant Examiner*—Victor Batson
*Attorney, Agent, or Firm*—Birch, Stewart, Kolasch & Birch, LLP

[57] ABSTRACT

An attachment detaching apparatus for hydraulic shovels includes a bracket pivoted, through an arm pin and a link pin, respectively, on a tip end of the arm of the hydraulic shovel. Guide grooves are provided with the opening portion being notched into the bracket. An oscillating arm where the opening portion has a notch located on the side opposite to the guide groove or the sliding slider is provided in a location opposite to the guide groove. An opening, closing apparatus for opening or closing the oscillating arm or the sliding slider is provided, the opening, closing apparatus is driven in the engaging direction by the engagement of a pin A of the attachment with the guide groove of the bracket and of a second pin B with the notch of the oscillating arm or the sliding slider so as to retain the attachment. A rotating hook, capable of grasping the pin A, is pivoted on the bracket through the rotating shaft. The rotating shaft is provided in a position where the rotating force in a direction of closing the rotating hook is applied when the pin A is operated in a direction along which the pin A is disengaged along the guide groove. The attachment detaching apparatus for hydraulic shovels has an opening, closing apparatus composed through the rotating hook, the oscillating arm or the sliding slider.

16 Claims, 4 Drawing Sheets

ATTACHMENT DETACHING APPARATUS FOR HYDRAULIC SHOVEL

BACKGROUND OF THE INVENTION

1. Field of the Invention

The present invention relates to an attachment detaching apparatus for a hydraulic shovel.

2. Description of Background Art

As shown in FIG. 5, an attachment detaching apparatus is needed for easily detaching a bucket 103, a hydraulic breaker 104, a crushing machine 105 or the like from a bracket 107 on an arm 102 of the hydraulic shovel 101. The bracket 107 is provided on which the various types of attachments are detachably mounted. The bracket 107 is pivoted on the tip end of the arm 102 through an arm pin 108 and a link pin 109.

The mounting and detaching operations require skill and much labor for mounting or detaching various types of attachments on the hydraulic shovel 101. It is necessary to correctly cooperate the mounting portion of the attachment with the arm 102 of the hydraulic shovel 101, and pull and push a heavy arm pin 108 and a link pin 109 into the appropriate apertures.

The attachment detaching apparatus, as shown in FIGS. 6 and 7, was developed to be capable of detaching and attaching a bucket or other member from an arm of a hydraulic shovel without the pulling or pushing of the arm pin 108 and the link pin 109. The bracket 107 is pivoted through the arm pin 108 and the link pin 109, respectively, on the tip end of the arm 102 of the hydraulic shovel 101.

As illustrated on the left side of FIGS. 6 and 7, a guide groove 111 is provided with an opening portion 110 which is notched in the bracket 107. An opening portion 112, illustrated on the right side of FIGS. 6 and 7, is provided with a circular notch 113 located on the side opposite to the guide groove 111. An oscillating arm 114 with a base end being pivoted on the link pin 109 or a slider 115 moving linearly along the guide 119 of the bracket 107 is provided in a location opposite to the guide groove 111.

An opening, closing apparatus 116 for opening, closing the oscillating arm 114 or the sliding slider 115 is respectively pivoted with one end in one bracket 107 and the other end in the oscillating arm 114 or in the sliding slider 115. The attachment is adapted to be retained within the opening, closing apparatus 116 being driven in the engaging direction by the engagement of one pin A of the attachment, with the guide groove 111 of the bracket 107 and the other pin B with the notch of the oscillating arm 114 or oscillating slider 115.

In the attachment detaching apparatus, the opening closing apparatus 116 extends to retain the pin A and the pin B of the attachment for engaging the attachment. The opening, closing apparatus 116 is contracted to release the attachment. Drilling, hitting or crushing operations effect forces in all the directions upon the pins A and B of the attachment.

As shown in FIGS. 6 and 7, when one pin A has a force, as illustrated in the arrow direction, in a direction along the guide groove 111 of the bracket 107, the force is adapted to be supported by the opening, closing apparatus 116 provided serially in the oscillating arm 114 or the sliding slider 115 receiving the other pin B, the distance between the pins A and B of the attachment is constant by the attachment.

Therefore, when an excessively force is applied upon the opening, closing apparatus 116, the opening, closing apparatus 116 was often broken.

SUMMARY AND OBJECTS OF THE INVENTION

In order to overcome the disadvantages as described so far, an attachment detaching apparatus for a hydraulic shovel has been proposed. To remove the problem of failing for the opening closing apparatus, the invention is adapted to have no force applied on the movable arm or the sliding slider if the force is applied in a direction along which the pin A is disengaged along the guide groove of the stationary hook. In the attachment detaching apparatus of the hydraulic shovel, a bracket is respectively pivoted, through an arm pin and a link pin, on the tip end of the hydraulic shovel. Guide grooves provided with the opening portion are notched on the bracket. The oscillating arm where the opening portion has a notch located on the side opposite to the guide groove or the sliding slider is provided in locations opposite to the guide groove. An opening, closing apparatus for opening, closing the oscillating arm or the sliding slider, the opening, closing apparatus is driven in the engaging direction by the engagement of one pin A of the attachment with the guide groove of the bracket and the other pin B in the notch of the oscillating arm or the sliding slider so as to retain the attachment. The rotating hook which is capable of grasping the pin A with the guide groove is pivoted on the bracket through the rotating shaft. A rotating shaft is provided in a position where the rotating force in a direction of closing the rotating hook is operated when the pin A is operated in a direction of being disengaged along the guide groove.

The attachment detaching apparatus for a hydraulic shovel has an opening, closing apparatus including an opening, closing apparatus through the rotating hook and the oscillating arm or the sliding slider.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
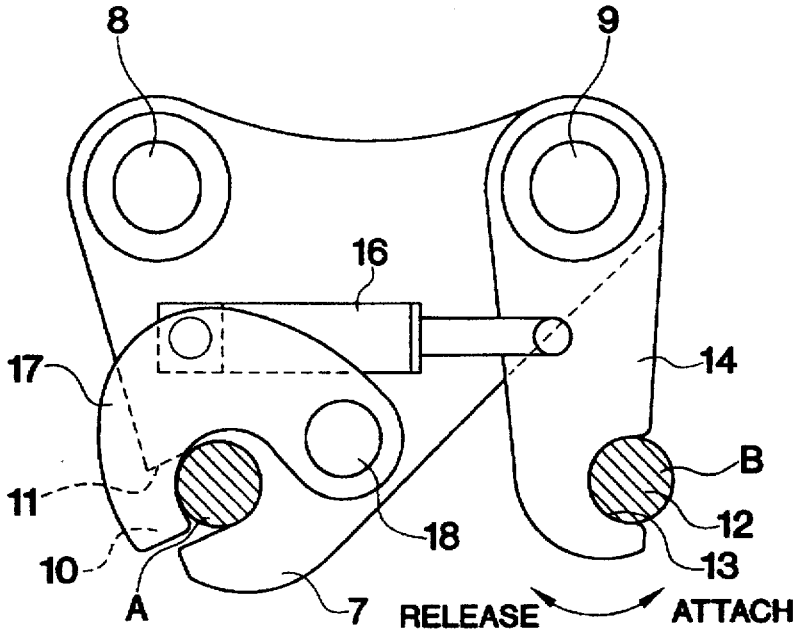
FIG. 1 is an elevational view showing the pins A and B of an attachment engaged in an attachment detaching apparatus using an oscillating arm of the present invention.

Now referring to the drawings, preferred embodiments of the invention are described below. The invention is an attachment detaching apparatus for a hydraulic shovel. The attachment detaching apparatus includes a rotating hook of a mechanism where a rotating force in a closing direction is applied when a force is applied in a direction along which a pin A is disengaged along the guide groove, in an apparatus where at the attachment engagement, one pin A of the attachment is grasped by the guide groove and the movable hook, the other pin B is supported by the movable arm or the slider.

Figure 2:
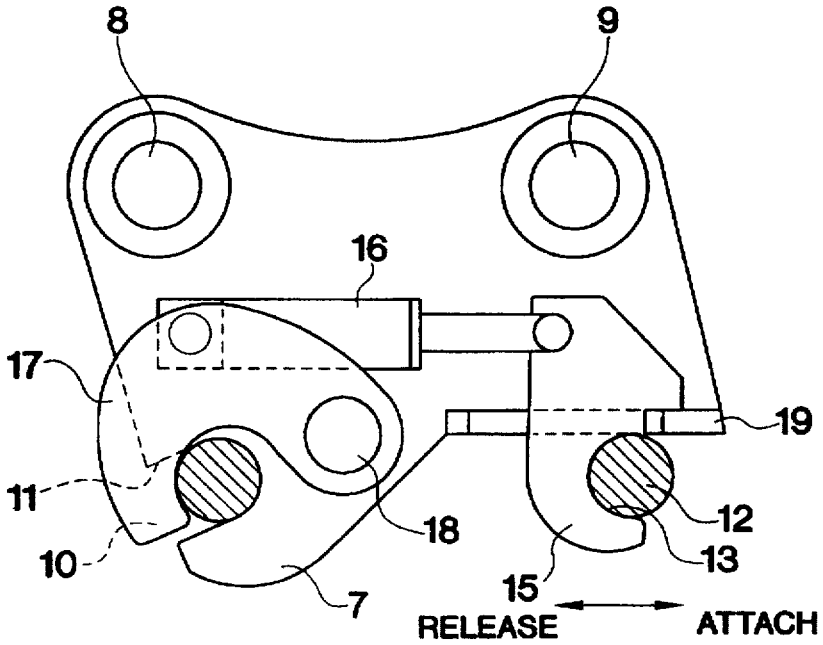
FIG. 2 is an elevational view showing the pin A and the pin B of an attachment engaged in an attachment detaching apparatus provided with a sliding arm of the present invention.

As shown in FIGS. 1 and 2, a bracket 7 is pivoted on the tip end of the arm of the hydraulic shovel through the arm pin 8 and the link pin 9, respectively.

Figure 3:
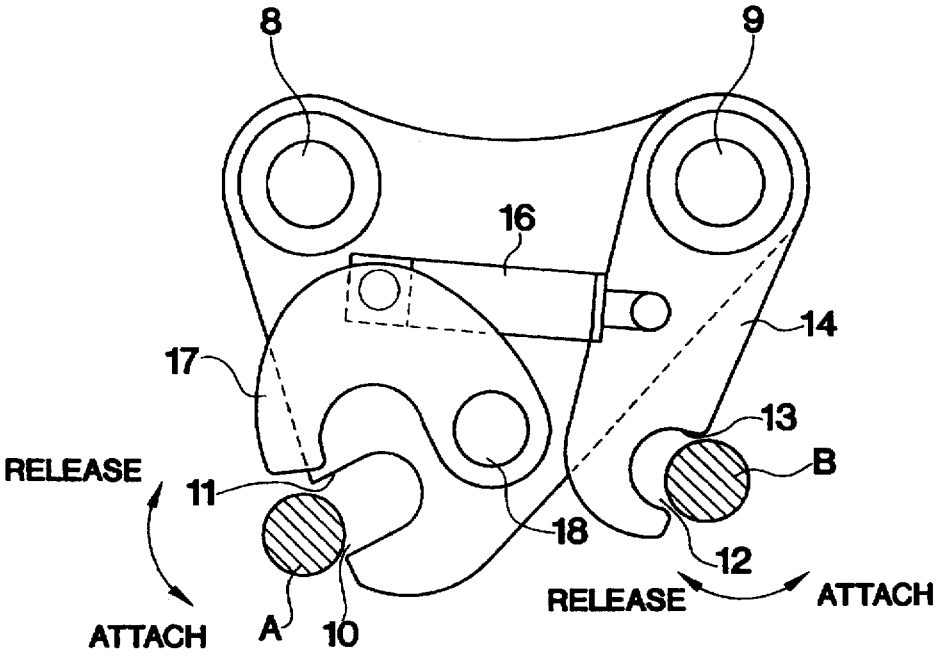
FIG. 3 is an elevational view showing the pin A and the pin B of the attachment released in an attachment detaching apparatus provided with an oscillating arm of the present invention.

As illustrated on the left side of FIGS. 1, 2 and 3, a guide groove 11 is provided in an opening portion 10, which is notched in the bracket 7. The opening portion 2, as illustrated on the right side in FIGS. 1, 2 and 3, is provided with a circular notch 13 located on the side opposite to the guide groove 11. An oscillating arm 14 with a base end being pivoted on the link pin 9 or a sliding glider 15 moving linearly along the guide groove 19 of the bracket 7 is provided in a location opposite to the guide groove 11.

An opening, closing apparatus 16 is provided which has the base end pivoted on the rotating hook 17 and the tip end pivoted on the oscillating arm 14 or the sliding cylinder 15, respectively. The opening, closing apparatus 16 is driven in an engaging direction with one pin A of the attachment being engaged with the guide groove 11 of the bracket 7, the other pin B being engaged in the notch 13 of the oscillating arm 14 or the notch 13 of the sliding slider 15 so as to retain the attachment with one pin A being grasped by the guide groove 11 and the rotating hook 17. Further, the opening, closing apparatus 16 is not limited to only a hydraulic type using a hydraulic cylinder, but also may be a manual type using a screw rod as the opening, closing apparatus 16. Also, to provide safety for the hydraulic cylinder, a double safety construction is provided with a lock valve, as shown.

A rotating hook 17 is rotatively provided through a rotating shaft 18 on the bracket 7 so that the pin A may be grasped by the guide groove 11. A rotating shaft 18 is provided in a position where a rotating force in a direction of the rotating hook 17 is closed is applied when the force is applied in a direction along which the pin A is disengaged along the guide groove 11.

FIG. 1 shows a condition where the opening, closing apparatus 16 extends by the detaching apparatus using the oscillating arm 14 to engage the attachment. FIG. 2 shows a condition where the opening, closing apparatus 16 is extended by the detaching apparatus using the sliding slider 15 to engage the attachment. FIG. 3 illustrates an operation where the opening, closing apparatus is contracted by the detaching apparatus using the oscillating arm 14 to release the attachment.

Figure 4:
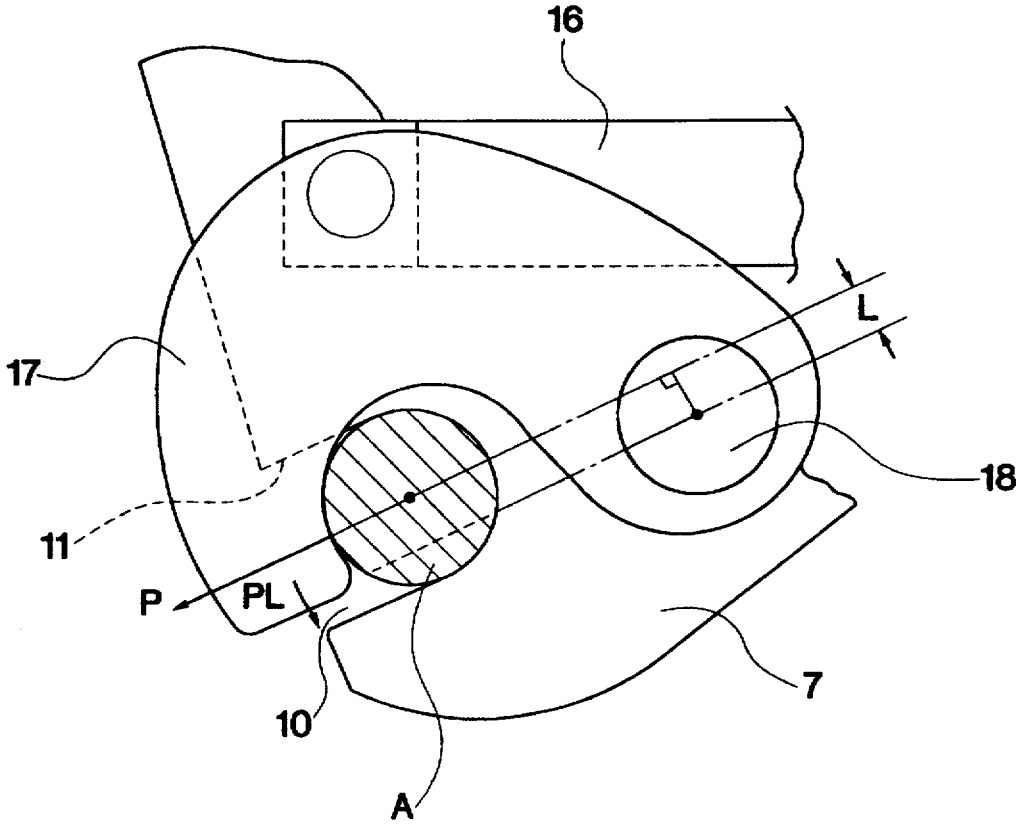
FIG. 4 is an enlarged elevational view of the essential portions showing a pin A grasped by the guide groove and the rotating hook and a rotating force for closing the guide groove is applied on the rotating hook in the attachment detaching apparatus of the present invention.
Figure 5:
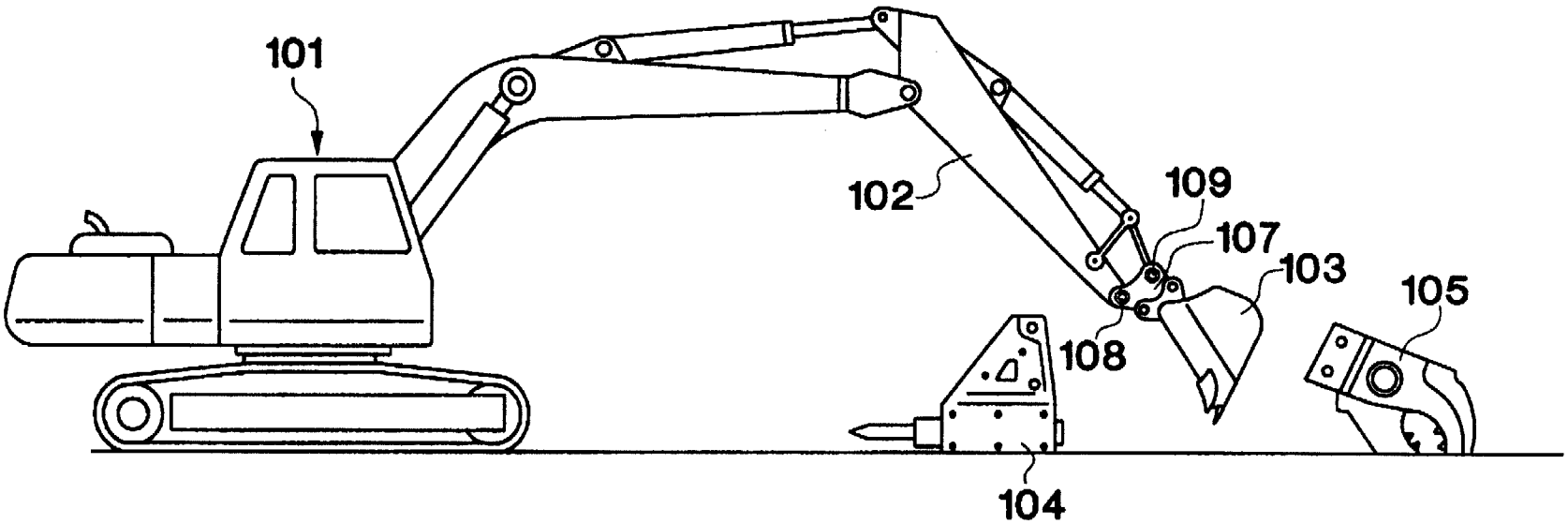
FIG. 5 is an elevational view explaining the condition for various types of conventional hydraulic attachments for operating machines.
Figure 6:
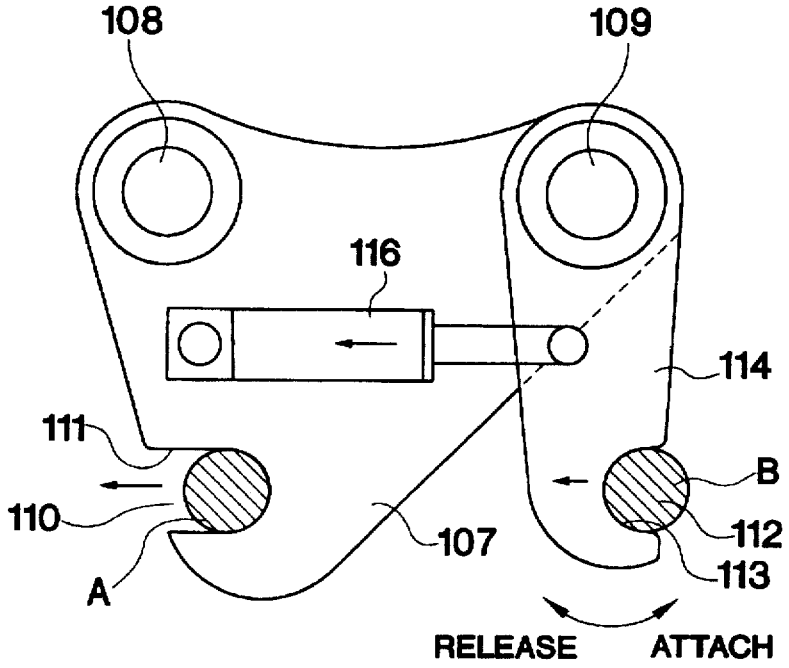
FIG. 6 CONVENTIONAL ART
FIG. 6 is an elevational view showing pins A and B of the attachment engaged in the attachment detaching apparatus provided with the conventional oscillating arm.
Figure 7:
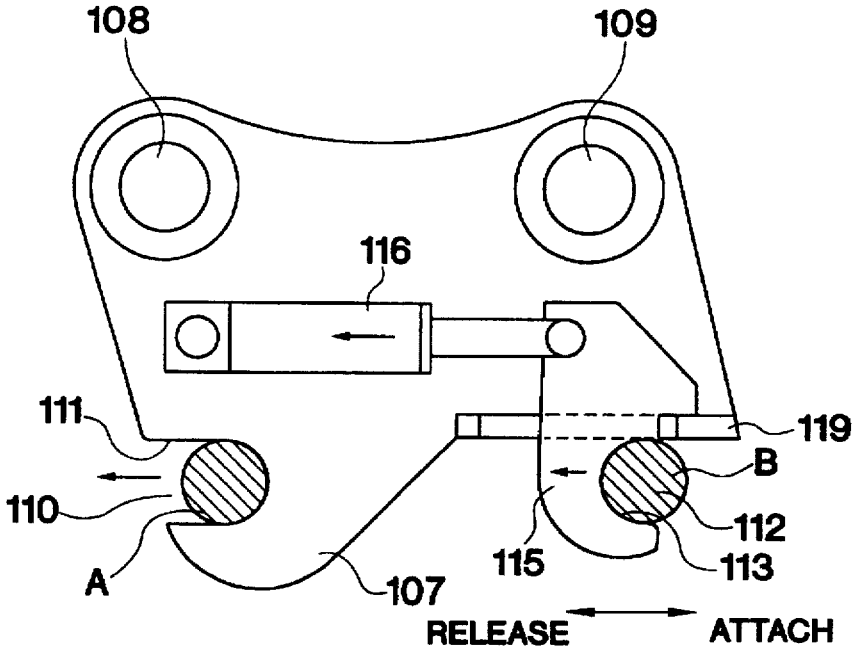
FIG. 7 CONVENTIONAL ART
FIG. 7 is an elevational view showing pins A and B of the attachment engaged in the attachment detaching apparatus provided with the conventional oscillating arm.

FIG. 4 is a detailed view of the rotating hook 17 and the pin A. The operation of the rotating force in a direction of closing the rotating hook 17 will be described. Assume that a force for the pin A to pull out along the guide groove 11 is P and a distance to the force P for the pin A to pull out from the center of the rotating axis 18 is L, and the moment around the rotating axis 18 of the rotating hook 17 is PL. The direction of the moment PL closes in a direction of closing the guide groove 11 in a direction shown in FIG. 4 to move in a direction of retaining the pin A. The rotating force, moment, of closing the guide groove 11 with the rotating hook 17 becomes larger in proportion to a force P for the pin A to pull out along the guide groove 11, assuming that the distance L is made constant to the force P for the pin A to pull out from the center of the rotating axis 18.

The sliding slider 15 is suitable for compacting the attachment detaching apparatus, while the sliding slider 15 is composed of simpler parts. Here is shown an example of using the oscillating arm 14 to retain the pin B and an example of using the sliding slider 15.

In the attachment detaching apparatus of the hydraulic shovel in accordance with the invention, the bracket is respectively pivoted through an arm pin and a link pin on the tip end of the hydraulic shovel, guide grooves provided with the opening portion are notched on the bracket for the oscillating arm where the opening portion has a notch located on the side opposite to the guide groove or the sliding slider is provided in a location opposite to the guide groove, an opening, closing apparatus for opening or closing the oscillating arm or the sliding slider, the opening, closing apparatus is driven in the engaging direction by the engagement of one pin A of the attachment with the guide groove of the bracket and of the other pin B with the notching of the oscillating arm or the sliding slider so as to retain the attachment. The rotating hook is capable of being pivoted through the rotating axis for grasping the pin A with the guide groove. A rotating shaft is provided in a position where the rotating force in a direction of closing the rotating hook is applied when the pin A is operated in a direction of being disengaged along the guide groove. The attachment detaching apparatus for a hydraulic shovel has an opening, closing apparatus including the opening, closing apparatus which utilizes the rotating hook, the oscillating arm or the sliding slider. A rotating shaft is provided in a position where the rotating force is applied for closing the rotating hook when a force for the pin A tries to be disengaged from along the guide groove, the pin A can be retained more reliably so that no force can be applied upon the opening, closing apparatus.

Also, in the preset invention, the distance between the pins A and B for attachment use is constant by the attachment and the pin A is grasped by the guide groove and the rotating hook if the force is applied upon the attachment. The pin B does not move in the direction of the pin A so that the force is not transmitted to the opening, closing apparatus, and thus the opening, closing apparatus does not fail.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attachment detaching apparatus for hydraulic shovels comprising:

a bracket adapted to be pivoted, through an arm pin and a link pin, respectively, on a tip end of a hydraulic shovel;

a guide groove formed in said bracket and including an opening portion notched into the bracket;

an oscillating arm mounted on said bracket and including at least one opening portion which is a notch located on a side of said bracket in a location opposite to the guide groove;

an opening, closing apparatus for opening or closing the oscillating arm, said opening, closing apparatus being driven in an engaging direction and adapted to engage a first pin of the attachment with the guide groove of the bracket and a second pin with the notch of the oscillating arm for retaining the attachment; and a rotating hook adapted to grasp the first pin, said rotating hook being pivoted on the bracket through a rotating shaft wherein said rotating hook includes a first end pivoted on the bracket and a second end adapted for opening and closing the guide groove formed in said bracket;

said rotating shaft being mounted wherein a moment in a direction of closing the rotating hook is applied to said hook when a force is applied in a direction of disengaging the first pin along the guide groove, and said opening, closing apparatus is mounted to both the rotating hook and the oscillating arm.

2. The attachment detaching apparatus for hydraulic shovels according to claim 1, wherein said guide groove extends at a predetermined angle relative to the positioning of the arm pin and link pin for positioning said first pin therein.

3. The attachment detaching apparatus for hydraulic shovels according to claim 1, wherein said oscillating arm is mounted for rotation on said link pin.

4. The attachment detaching apparatus for hydraulic shovels according to claim 1, wherein said opening, closing apparatus is a hydraulic cylinder and piston member mounted to said oscillating arm and said rotating hook for imparting movement thereto.

5. The attachment detaching apparatus for hydraulic shovels according to claim 1, wherein retracting said piston imparts movement to said oscillating arm and said rotating hook for releasing said first and second pins from the bracket.

6. The attachment detaching apparatus for hydraulic shovels according to claim 1, wherein actuating the hydraulic cylinder imparts movement to said oscillating arm and said rotating hook for retaining the first and second pins relative to said bracket.

7. The attachment detaching apparatus for hydraulic shovels according to claim 1, wherein a center point of a rotating axis of the pivoted first end of said rotating hook is disposed to be offset a predetermined distance relative to a center point of said first pin disposed within said guide groove for producing said moment for assisting in the retaining of the first pin within the guide groove.

8. The attachment detaching apparatus for hydraulic shovels according to claim 1, wherein the second end of the rotating hook is curved to provide a recess for retaining said first pin.

9. An attachment detaching apparatus for hydraulic shovels comprising:

a bracket adapted to be pivoted, through an arm pin and a link pin, respectively, on a tip end of a hydraulic shovel;

a guide groove formed in said bracket and including an opening portion notched into the bracket;

a sliding slider mounted on said bracket and including at least one opening portion which is a notch located on a side of said bracket in a location opposite to the guide groove;

an opening, closing apparatus for opening or closing the sliding slider, said opening, closing apparatus being driven in an engaging direction and adapted to engage a first pin of the attachment with the guide groove of the bracket and a second pin with the notch of the sliding slider for retaining the attachment; and a rotating hook adapted to grasp the first pin, said rotating hook being pivoted on the bracket through a rotating shaft;

said rotating shaft being mounted wherein a moment in a direction of closing the rotating hook is applied to said hook when a force is applied in a direction of disengaging the first pin along the guide groove, said opening, closing apparatus is mounted to both the rotating hook and the sliding slider, said guide groove extends at a predetermined angle relative to the positioning of the arm pin and link pin for positioning said first pin therein, said guide groove guides said first pin in a direction towards a center of said rotating shaft during engagement.

10. The attachment detaching apparatus for hydraulic shovels according to claim 9, wherein said sliding slider is mounted for reciprocation on said bracket.

11. The attachment detaching apparatus for hydraulic shovels according to claim 9, wherein said opening, closing apparatus is a hydraulic cylinder and piston member mounted to said sliding slider and said rotating hook for imparting movement thereto.

12. The attachment detaching apparatus for hydraulic shovels according to claim 9, wherein retracting said piston imparts movement to said sliding slider and said rotating hook for releasing said first and second pins from the bracket.

13. The attachment detaching apparatus for hydraulic shovels according to claim 9, wherein actuating the hydraulic cylinder imparts movement to said sliding slider and said rotating hook for retaining the first and second pins relative to said bracket.

14. The attachment detaching apparatus for hydraulic shovels according to claim 9, wherein said rotating hook includes a first end pivoted on the bracket and a second end adapted for opening and closing the guide groove formed in said bracket.

15. The attachment detaching apparatus for hydraulic shovels according to claim 9, wherein a center point of a rotating axis of the pivoted first end of said rotating hook is disposed to be offset a predetermined distance relative to a center point of said first pin disposed within said guide groove for producing said moment for assisting in the retaining of the first pin within the guide groove.

16. The attachment detaching apparatus for hydraulic shovels according to claim 9, wherein the second end of the rotating hook is curved to provide a recess for retaining said first pin.

* * * * *